United States Patent [19]

Lycan

[11] Patent Number: 4,639,558

[45] Date of Patent: Jan. 27, 1987

[54] REVERSING SWITCH

[75] Inventor: Jennings Lycan, Huntington, W. Va.

[73] Assignee: Service Machine Co., Huntington, W. Va.

[21] Appl. No.: 815,520

[22] Filed: Jan. 2, 1986

[51] Int. Cl.[4] ..... H01H 9/00

[52] U.S. Cl. ..... 200/1 V; 200/16 E; 200/163

[58] Field of Search ..... 200/1 R, 1 V, 11 EA, 200/11 TC, 16 E, 17 R, 18, 153 R, 163, 335

[56] References Cited

U.S. PATENT DOCUMENTS 3,315,057 4/1967 Geltner ..... 200/1 V X 4,563,549 1/1986 Lycan ..... 200/1 V

*Primary Examiner*—J. R. Scott

*Attorney, Agent, or Firm*—McCaleb, Lucas & Brugman

[57] ABSTRACT

A reversing switch comprises a mounting plate assembly with a hub extending forwardly through a wall of an explosion proof enclosure. A shaft is journaled for rotational and axial movement in the hub. A stationary contact assembly includes four circumferentially spaced contacts. A moveable contact assembly includes four circumferentially spaced contacts mounted on the shaft. The shaft extends through an external operator member at the forward end of the hub. The operator member is connected to the hub by a groove and flange arrangement preventing fore and aft movement but enabling rotational movement about the hub. A pair of forwardly extending side walls each with a transverse guide slot are connected to the operator member. A handle member with a pair of combined lever and cam arms is connected to the operator member and the shaft. A pair of bosses on the lever and cam arms are seated in the guide slots and there is a pivotal connection between the shaft and portions of the lever arms offset eccentrically from the bosses. The bosses act as moveable fulcrums moving in the guide slots in response to forward and backward swinging movements of the handle. A pair of cam surfaces on the handle engage the operator member and supplement the action of the levers in moving the shaft.

11 Claims, 15 Drawing Figures

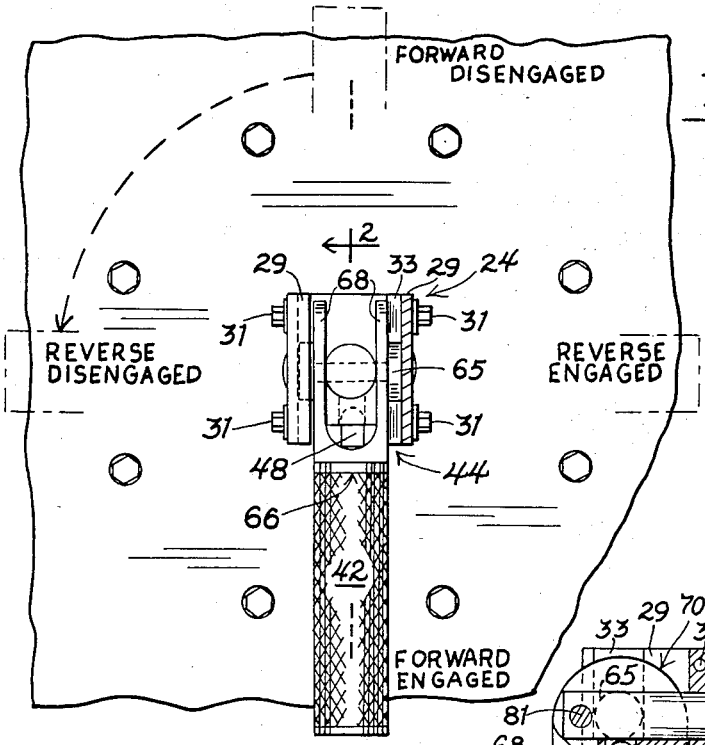
Fig. 1
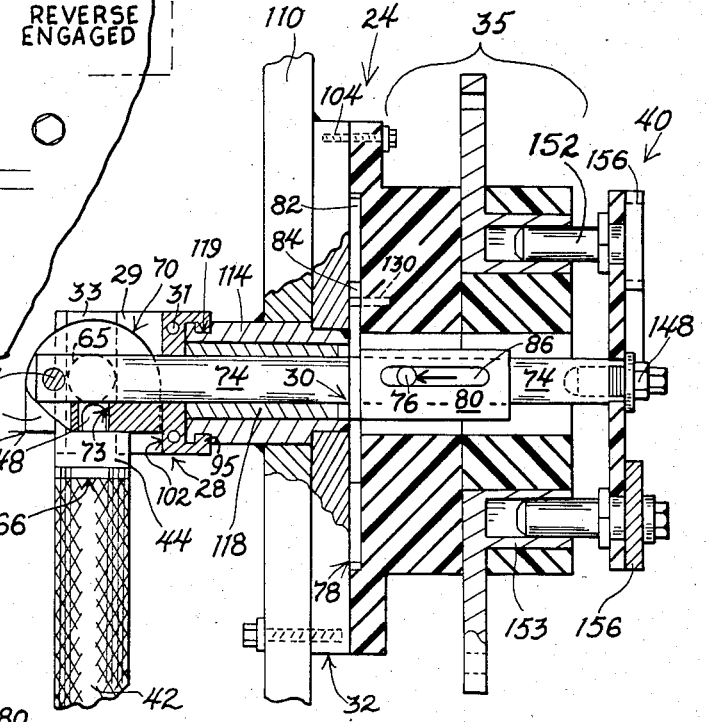
Fig. 2
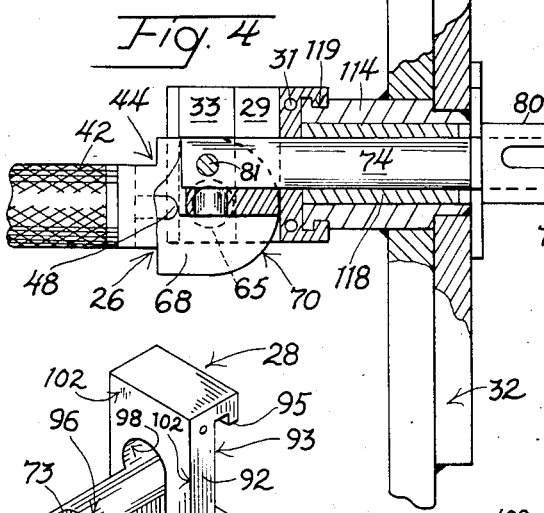
Fig. 4
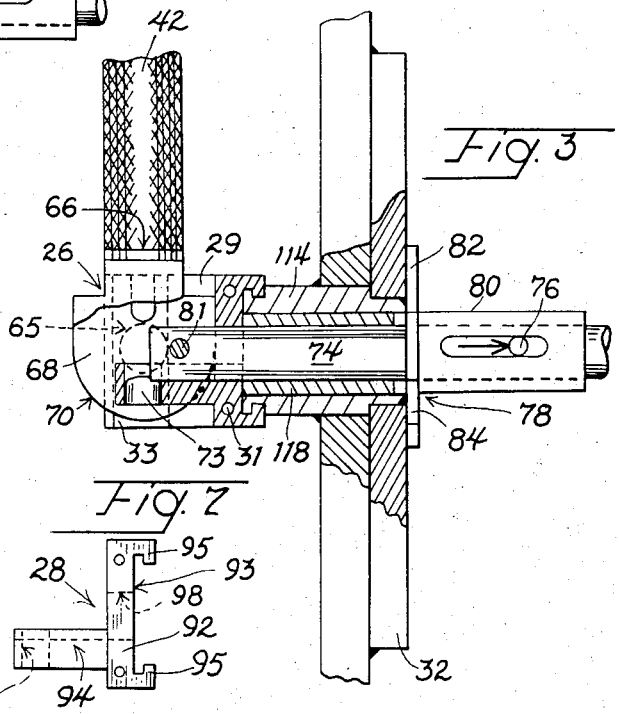
Fig. 3
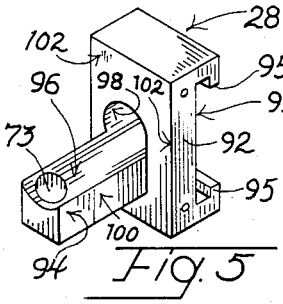
Fig. 5
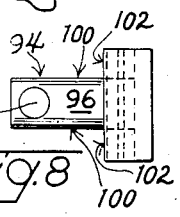
Fig. 8
Fig. 7
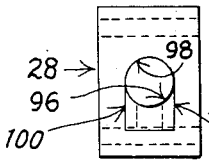
Fig. 6

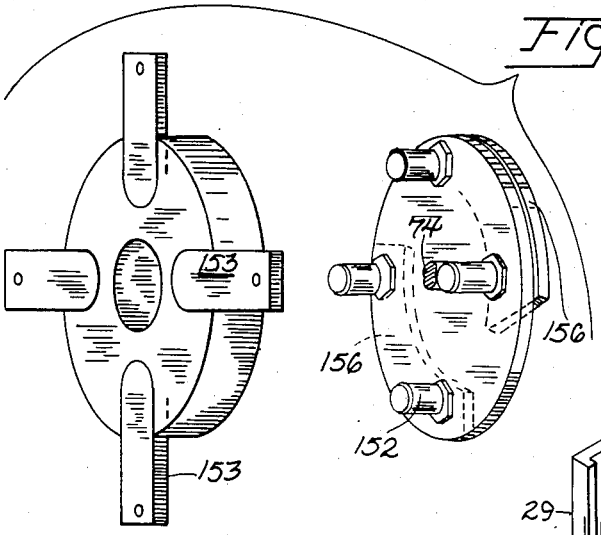
Fig. 9
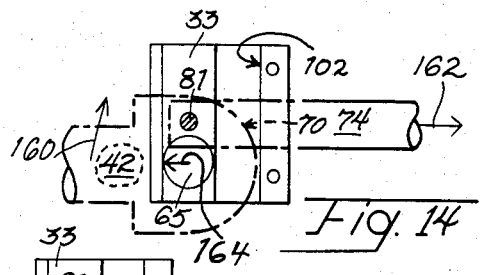
Fig. 14
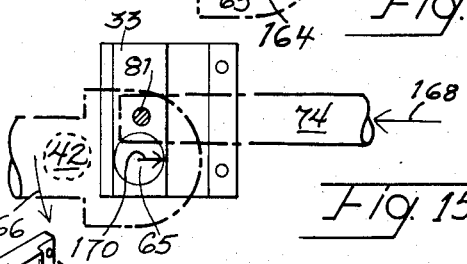
Fig. 15
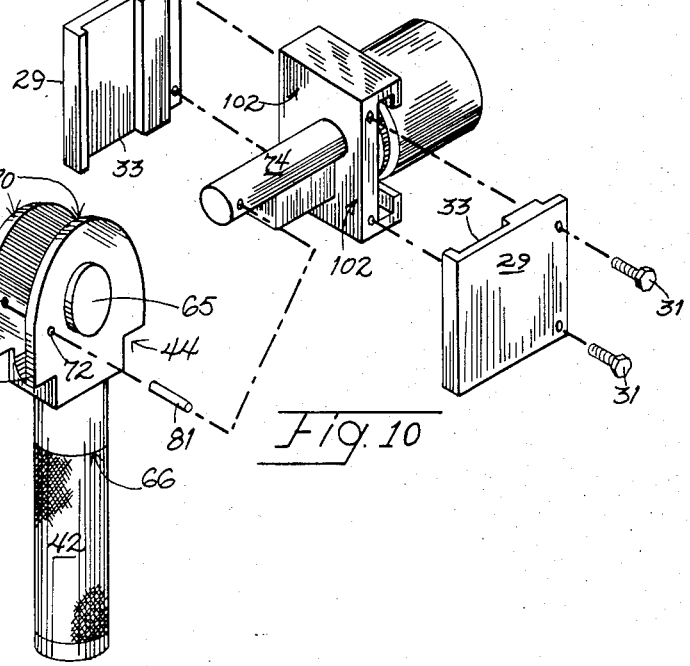
Fig. 10
Fig. 11
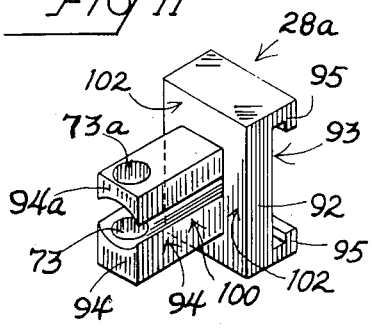
Fig. 12
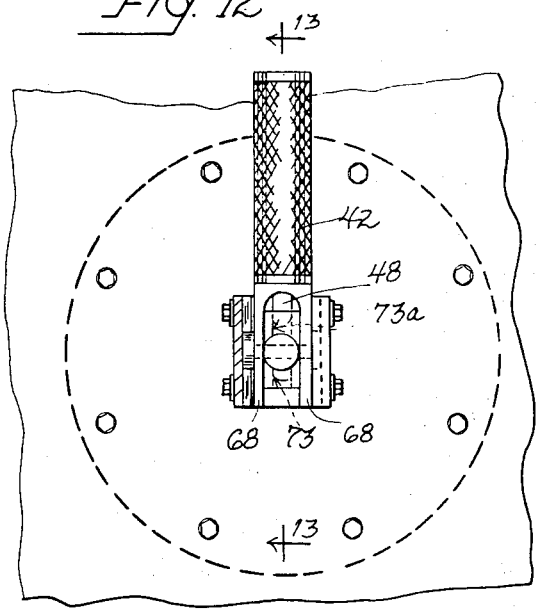
Fig. 13
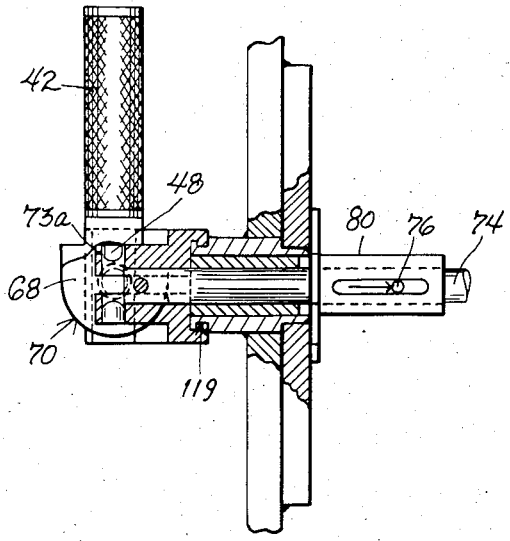

REVERSING SWITCH

BACKGROUND OF THE INVENTION

The invention belongs to the field of electrical switches and particularly to a reversing switch for large three phase induction motors.

Bulk materials handling conveyors, such as those used in underground coal mines, are examples of electrically driven equipment which commonly requires reversing facilities. Electrical power equipment used near the working face in coal mines must be "explosion proof" to prevent electrical sparks or arcs from igniting any explosive mixture of air and methane or coal dust which may be present. Hence any electrical reversing switch intended for use on coal face equipment must be in an explosion proof enclosure. Reversing switch mechanisms previously available have not been easily or inexpensively adaptable for use within explosion proof enclosures.

In certain applications, such as the electric drive and controls for a coal plow operating along the face in a longwall mining system, the motor drive is operated forward and then reverse in a cyclic manner. The motor control equipment includes separate forward and reverse contactors which are operated alternately. That arrangement while effective for such special purposes is objectionably bulky and expensive for many other motor reversing applications such as conveyors which run in one direction to move coal out of the mine but are reversed from time to time to move supplies and personnel into the mine.

One reversing switch previously available for this purpose was disclosed in applicant's U.S. application Ser. No. 06/662,493 filed Oct. 18, 1984 on "REVERSING SWITCH", now U.S. Pat. No. 4,563,549.

Applicant's above-described prior switch was positively closed by cam mechanism on the handle which forced the contacts together. However, the contacts were spring-urged apart and could not be forced open by swinging the handle. While the switch operated satisfactorily, it has since been recognized that there would be an advantage in positively opening the contacts as well as positively closing them with the handle.

SUMMARY OF THE INVENTION

Accordingly, it is a general object of the present invention to provide a high capacity reversing switch for a three-phase power source which is simple, compact, easily fitted for use in an explosion proof enclosure and which positively opens the contacts as well as closes them in response to swinging movement of the handle.

A specific object of the invention is to provide a reversing switch which is a positive-opening and positive-closing improvement over the switch described in the above patent.

Another object is to provide a reversing switch usable in an explosion proof enclosure in which the only opening to the potentially explosive ambient mine atmosphere is through an operating-shaft-guiding hub which may be made of suitable length to safely quench any flame or burning gases exiting through the hub.

Another object is to provide a reversing switch with an external dual motion handle which is swingable forward and backward to move internal contact assemblies between engaged and disengaged positions, and is also swingable or rotatable sidewise to move the contact assemblies between forward and reverse conductive modes.

Another object is to provide an electrical reversing switch in which an external handle operates internal contact assemblies via a shaft which is selectively moveable in both rotary and axial directions, the shaft is moveable in the rotary direction by a direct connection to the handle, and the shaft is moveable in the axial direction by a unique lever connection to the handle which provides a maximum mechanical advantage between the handle and the moving contact assemblies when the latter are in their fully closed and fully opened positions relative to the stationary contact assemblies.

Another object of the present invention is to provide such a reversing switch with cam mechanism acting between the handle and shaft to supplement the lever connection in moving the shaft in a closing direction.

Another object is to provide a reversing switch as described comprising a specific improvement over that disclosed in U.S. Pat. No. 4,563,549 in the respect that the operating member and hub are interconnected to prevent fore and aft movement of the operator member relative to the hub while enabling rotation of the operator member with the handle about the hub.

Another object is to provide such an improved reversing switch in which the operator member and hub are interconnected by interengaging groove and flange mechanism.

Another object is to provide such an improved reversing switch in which the operator member has a pair of oppositely-disposed transverse recesses and the handle has a manually retractible locking plunger selectively engageable in one or the other of those recesses to lock the handle in either of two oppositely swung positions corresponding to fully opened and fully closed positions of the contact assemblies.

Another object is to provide at least one guide wall on the operator member extending forwardly alongside a lever arm carried by the handle, a guide slot in the guide wall elongated in a direction transverse to the axis of the shaft, a boss on the lever arm extending sidewardly into engagement with the guide slot, and a pivotal connection between the shaft and a portion of the lever arm offset from the boss, thereby enabling the boss to act as a moving fulcrum moveable within the guide slot to support the pivotal connection for moving the shaft both backwardly and forwardly in response to backward and forward swinging movements of the handle.

Another object is to provide an arcuate cam surface on the handle engageable with a surface on the operator member to supplement the lever arm in moving the shaft in a direction to close the contacts.

BRIEF DESCRIPTION OF THE DRAWINGS

Other objects and advantages will be apparent from the drawings in which:

FIG. 1 is a front elevational view of a reversing switch in a forward engaged mode with the handle down and showing in broken lines the handle positions for forward disengaged, reverse engaged and reverse disengaged modes;

FIG. 2 is a longitudinal sectional view of FIG. 1 taken along line 2—2;

FIG. 3 is a fragmentary view similar to FIG. 2 showing the handle up in the forward disengaged mode for the switch;

FIG. 4 is a view similar to FIG. 3 with the switch in an intermediate position halfway between the positions of FIGS. 2 and 3;

FIG. 5 is a perspective view of an operator member employed in the switch shown in FIGS. 1–4;

FIGS. 6, 7 and 8 are front, side and top views respectively of the operator member shown in FIG. 5;

FIG. 9 is a fragmentary, exploded perspective view of the stationary and moveable contact assemblies shown in FIG. 2;

FIG. 10 is an exploded perspective view of the handle, operating member and associated parts used in the switch;

FIG. 11 is a view similar to FIG. 5 of a modified form of operator member;

FIG. 12 is a front elevational view of another embodiment of the switch utilizing the modified form of operator base component shown in FIG. 11, with the switch being shown locked in forward disengaged mode;

FIG. 13 is fragmentary, longitudinal sectional view of FIG. 12 taken on line 13—13;

FIG. 14 is a fragmentary view of the operator member and the handle and shaft showing one of the bosses on the handle bearing against the forward edge of one of the guide slots in the operator member to provide thrust reaction forcing the shaft backwardly in response to upward swinging movement of the handle; and FIG. 15 is a view similar to FIG. 14 showing the boss bearing against the rearward edge of the guide slot in response to downward swinging movement of the handle.

BRIEF DESCRIPTION OF THE PREFERRED EMBODIMENTS

Inasmuch as this invention is an improvement over the reversing switch described in U.S. Pat. No. 4,563,549, the same reference numerals will be used for the same components in the interest of consistency, and only the new components and their functions will be described in detail. For a more detailed description of the reversing switch housing, and shaft and contact assemblies, reference should be made to U.S. Pat. No. 4,563,549.

Referring now to a specific embodiment shown in FIGS. 1–10, 14 and 15, the reversing switch 24 comprises the following major components as seen from left to right in FIG. 2:

an operating handle assembly 26;
an operator member 28;
a rotary shaft assembly 30;
a mounting plate assembly 32;
a stationary contact assembly 35; and
a moveable contact assembly 40.

The operating handle assembly 26 comprises a handle 42 telescopically slidable on the outside of a bifurcated combined lever and cam member 44. A lock detent or plunger 48 is axially moveable with the handle against a spring (not shown). The spring urges the handle 42 toward a locked position abutting shoulder 66 where the plunger 48 extends through the lever and cam member to the position shown in FIG. 2 and several of the other figures. The bifurcated lever and cam member 44 has a pair of transversely spaced flat arms 68, 68 (FIG. 10) with a circular boss 65 on the outside of each. Arcuate cam faces 70, 70 are provided on the forward end edges. These are preferably but not necessarily circular arcs struck from centers of the bosses 65. A pivot pin 81 is connected between a shaft 74 and openings 72 in arms 68, 68. The openings 72 are eccentrically located, offcenter from the bosses 65. The centers of the bosses 65 and pins 81 and the axis of shaft 74 are coplanar when the handle assembly is in either of the diametrically opposed positions shown in FIGS. 2 and 3, thereby providing maximum mechanical advantage as needed when the moveable contact assembly is moved at either extreme end of its travel range, as will be described.

The operator member 28 is an important part of the present invention and is shown individually in FIGS. 5–8. An optional embodiment 28*a*, providing double locking capability will be described later and is shown in FIG. 11.

Referring to the first operator member embodiment 28, it comprises a vertical base portion 92 with a flat back surface 93. A pair of straight, parallel inwardly extending flanges 95 are equidistantly spaced behind the surface 93. An integral tongue portion 94 extends forwardly from the base portion 92. The tongue portion 94 has an upper (FIGS. 1–8), cylindrical, concave surface 96 aligned with opening 98 in base portion 92 to receive and support the forward end portion of shaft 74. The central tongue portion 94 is of sufficient width that its flat side surfaces 100, 100 fit snugly between lever and cam arms 68, 68 so the operator member 28 will readily be rotated with the handle assembly 26 without excessive lost motion between the parts. The sides of base portion 92 which extend beyond surfaces 100 provide guide surfaces or tracks 102 which may engage the arcuate cam faces 70, 70 and supplement the lever action in moving the shaft as will be explained.

A transverse locking recess 73 is provided in the forward end of the tongue portion 94. As shown in FIG. 2, it receives the detent plunger 48 to hold the switch contacts in their fully engaged position.

As best shown in FIG. 2, the rotary shaft assembly 30 includes the central shaft 74 with a radial pin 76, and a rotary stop member 78 consisting of a sleeve 80 slidably mounted on the shaft 74 with a transverse circular plate or flange 82 having a quadrantal cut-out 84 and stop pin 130 limiting rotation of the handle assembly to a quarter turn. These components are shown and described in more detail in the above patent.

The shaft 74 is limitedly longitudinally slidable within the rotary stop member 78, but the two are concurrently rotatable in either direction because of the engagement of the radial pin 76 in longitudinal slot 86 in sleeve 80. The forward end portion of shaft 74 is axially moveable along concave surface 96 of the operator member 28 and its extreme forward end is pivotally connected by pin 81 to eccentric locations on the lever arms 68, 68 as described above. At its extreme rear end, the shaft 74 is connected to the moveable contact assembly 40 by fastening means including a cap screw 148.

Spaced, parallel operator guide walls 29 are fastened to opposite sides of the operator member 28 by bolts 31, 31. Each guide wall has a guide slot 33 on the inside sized for a corresponding one of the circular bosses 65 to fit and slide transversely along it when the handle assembly is swung forwardly and backwardly. As shown, the guide slots 33 are parallel and elongated in a direction transverse to the shaft 74.

The mounting plate assembly 32 comprises a plate 104 suitably fastened to a wall 110 of, for example, an explosion proof enclosure. A central hub 114 extends forwardly through the walls 104 and 110. A sleeve bearing liner 118 journals shaft 74 for both rotary and axial movement. A circular groove 119 is provided in the outer cylindrical extension of the hub.

The stationary contact assembly 35 and the moveable contact assembly 40 may be the same as described in U.S. Pat. No. 4,563,549, to which reference should be had for details. Briefly, the stationary contact assembly 35 has four equally circumferentially spaced socket contacts 153 connectible in the usual way to electrical power leads and a three-phase induction motor (not shown). The moveable contact assembly 40 has four pin contacts 152 with adjacent pairs interconnected on the backside by arcuate power bus jumpers 156 as best shown in FIGS. 2 and 9.

FIG. 11 shows an alternate embodiment of an operator member 28*a*. It is identical to operator member 28 except that it has an additional tongue 94*a* with a locking recess 73*a*. It provides positive locking of the handle assembly in both engaged and disengaged switch modes as will be described.

The flanges 95, 95 fit within diametrically opposite portions of the hub groove 119. This connects the operator member to the hub, preventing fore and aft movement of the operator member relative to the hub while enabling free rotation of the operator member and the handle assembly about the hub.

The bosses 65, guide slots 33, and arcuate cam surfaces 70 may be sized and proportioned to function in either of two ways: as a simple lever function in which the bosses 65 react against the front or back edges of guide slots 33 as moving fulcrums, while the pivot pins 81 move the shaft forwardly or rearwardly and the arcuate cam faces 70 remain out of contact with the track surfaces 102; and a combination lever and cam function in which the arcuate cam faces 70, 70 engage the tracks 102, 102 and supplement the lever action provided by the bosses 65 and pin 81 in closing the switch.

By providing the flanges 95, 95 straight and parallel as shown, the operator member can be assembled into the hub groove 119 simply by moving the latter sidewise into axial alignment with the hub before the shaft 74 is inserted.

FIGS. 14 and 15 are force diagrams showing the bosses 65 acting as fulcrums applying force reactions to the front and rear guide walls of the guide slots 33 while the bosses move up and down in the slots when the handle 42 is swung up and down from its FIG. 4 position. In FIG. 14, when the handle is swung upwardly along arrow 160, shaft 74 is moved rearwardly along arrow 162 while the force reactions from the bosses 65 are applied in the direction of arrow 164 against the front guide wall of slot 33. Conversely, in FIG. 15, when the handle is swung downwardly along arrow 166, shaft 74 is moved forwardly along arrow 168 while the force reactions from bosses 65 are applied in the direction of arrow 170 against the rear guide wall of slot 33.

Use and operation of the reversing switch is believed apparent from the foregoing description. Briefly, when the detent or plunger 48 is withdrawn from recess 73 (or 73*a*) in operator member 28 (or 28*a*) by pulling the handle 42 radially outwardly, the handle is freed to swing forwardly and backwardly to move the shaft longitudinally and either engage the contacts as shown in FIG. 2, or disengage them.

The switch has four significant operating modes corresponding to handle positions shown in FIG. 1 as follows:

(1) "forward engaged" mode with the handle down as shown in solid lines in FIG. 1, and in FIG. 2;
(2) "forward disengaged" mode with the handle up as shown in broken lines in FIG. 1 and in solid lines in FIG. 3;
(3) "reverse engaged" mode with the handle to the right as shown in broken lines in FIG. 1; and
(4) "reverse disengaged" mode with the handle to the left as shown in broken lines in FIG. 1.

Starting in the "forward engaged" mode with the handle down as shown in FIGS. 1 and 2, sliding the handle 42 radially downwardly releases the plunger 48 from the recess 73. Swinging the handle straight forwardly to the intermediate, level position shown in FIG. 4 moves the shaft 74 backwardly to begin disengagement of the contacts. Continued swinging of the handle upwardly and backwardly to the position of FIG. 3, and the upper broken line position of FIG. 1, completely disengages the contacts. The switch is now in its "forward disengaged" mode. Because the contacts are disengaged, the shaft 74 can be rotated a quarter turn as permitted by the quadrantal cut-out 84 in flange 82 and the stop pin 130.

The handle is then moved a quarter turn counterclockwise (FIG. 1) to its left hand "reverse disengaged" position. At this time a different combination of the contact pins 152 is aligned with the contact sockets 153 but still remain disengaged. Swinging the handle forwardly and to the right and then rearwardly to the right puts it in the "reverse engaged" mode position shown in FIG. 1. At this time the plunger 48 will be returned to the recess 73, thereby locking the contacts in this new, engaged mode.

In some cases, it may be desirable to have a positive lock in both the engaged and disengaged modes. For this purpose, the second tongue 94*a* may be provided with a second locking recess 73*a* as shown in the alternate operator embodiment 28*a* in FIG. 11. FIGS. 12 and 13 show the locking detent 48 engaged in this alternate recess 73*a* to lock the shaft 74 at the back end of its range of movement corresponding to the fully opened condition of the contacts.

While the specific forms of reversing switch described and shown constitute preferred embodiments of the invention, it is understood that the invention is not limited to these precise forms, and changes may be made therein without departing from the spirit and scope of the invention.

The embodiments of the invention in which a exclusive property or privilege is claimed are defined as follows:

1. In a reversing switch having an enclosure with a hub extending through a wall thereof, a shaft extending through said hub and being journaled therein for rotational and axial movement, stationary contact means circumferentially spaced within said enclosure, moveable contact means supported by said shaft and rotatable therewith in the axially displaced position to engage said stationary contact means in forward and reverse modes at opposite ends of a range of rotation of said shaft, an operator member at the forward end of the hub through which said shaft is axially and rotatably journaled, handle means connected to said shaft and having means engageable with said operator member to move said shaft back and forth longitudinally to open and close said contact means in response to backward and forward swinging movement of said handle means, said shaft and moveable contact means being rotatable by said handle means between selected positions prior to axial displacement to close said contact means, the improvement comprising: means interconnecting the operator member and hub preventing fore and aft movement of the operator member relative to the hub while enabling rotation of the operator member about the hub.

2. In a reversing switch, the combination of claim 1 in which the means interconnecting the operator member and hub comprises interengaging groove and flange means.

3. In a reversing switch, the combination of claim 2 in which the interengaging groove and flange means comprises outer groove means in a forward cylindrical extension of the hub, and inner flange means on the operator member engaging said groove means.

4. In a reversing switch, the combination of claim 1 in which the operator member has a pair of oppositely disposed transverse plunger-receiving recesses therein, and said handle means has a manually retractible locking plunger selectively engageable in said recesses to lock said handle means in either of two oppositely swung positions corresponding to opened and closed positions of said contact means.

5. In a reversing switch, the combination of claim 3 in which the outer groove means in the forward cylindrical extension of the hub is located in a plane transverse to the axis of the shaft, and said inner flange means on the operator member comprises at least one straight flange located in said plane and being assembleable into engagement with the groove by moving the operator member sidewise into axial alignment with the hub.

6. In a reversing switch, the combination of claim 1 including at least one lever arm on the inner end of the handle means and at least one guide wall on the operator member extending forwardly alongside the lever arm, a guide slot in said guide wall elongated in a direction transverse to the axis of said shaft, a boss on said lever arm extending sidewardly into engagement with said guide slot, and a pivotal connection between said shaft and a portion of said lever arm offset from said boss, whereby said boss acts as a moving fulcrum moveable within said guide slot to support said pivotal connection for moving said shaft backward and forward in response to backward and forward swinging movement of the handle means.

7. In a reversing switch, the combination of claim 6 in which said boss is circular and said handle means includes at least one arcuate cam surface engageable with a surface on said operator member to supplement said lever arm in moving said shaft in one direction.

8. In a reversing switch, the combination of claim 7 in which said cam surface is a segment of a circle struck from the center of said boss.

9. In a reversing switch, the combination of claim 1 in which:

the means interconnecting the operator member and hub comprises interengaging groove and flange means;

said operator member comprises forwardly extending tongue means with a pair of spaced, parallel, oppositely outwardly facing surfaces;

said handle means has a pair of bifurcated lever arms flanking said tongue means and being in close guiding relationship therewith;

a pair of guide walls on the operator member extends forwardly along the outer sides of said lever arms and in guiding relationship therewith;

said guide walls have guide slots elongated in a direction transverse to the axis of the shaft;

said lever arms have bosses extending sidewardly into engagement with said guide slots; and a pivotal connection is provided between said lever arms and said shaft eccentrically offset from said bosses;

whereby said bosses act as moving fulcrums moveable transversely within the respective guide slots to support said pivotal connection for moving said shaft backward and forward in response to backward and forward swinging movement of the handle means.

10. In a reversing switch, the combination of claim 9 in which said bosses are circular and said handle means includes a pair of arcuate cam surfaces engageable with corresponding surfaces on the operator member to supplement said lever arm in moving said shaft in one direction.

11. In a reversing switch the combination of claim 10 in which said bosses are circular and said cam surfaces are segments of circles struck from the centers of said bosses.

* * * * *